US005562425A

United States Patent [19]

Kimura et al.

[11] Patent Number: 5,562,425

[45] Date of Patent: Oct. 8, 1996

[54] GAS SUCTION STRUCTURE IN PISTON TYPE COMPRESSOR

[75] Inventors: Kazuya Kimura; Shigeyuki Hidaka; Hiroaki Kayukawa, all of Kariya, Japan

[73] Assignee: Kabushiki Kaisha Toyoda Jidoshokki Seisakusho, Kariya, Japan

[21] Appl. No.: 514,766

[22] Filed: Aug. 14, 1995

[30] Foreign Application Priority Data

Aug. 16, 1994 [JP] Japan ..... 6-192561

[51] Int. Cl.[6] ..... F04B 1/02

[52] U.S. Cl. ..... 417/269; 91/503

[58] Field of Search ..... 417/269; 91/503

[56] References Cited

U.S. PATENT DOCUMENTS 1,367,914 2/1921 Larsson .
5,207,078 5/1993 Kimura et al. ..... 417/269
5,393,205 2/1995 Fujii et al. ..... 417/269
5,397,218 5/1995 Fujii et al. ..... 417/269
5,419,685 5/1995 Fujii et al. ..... 417/269
5,429,482 7/1995 Takenaka et al. .

FOREIGN PATENT DOCUMENTS 4119370 10/1992 Japan .
5231310 9/1993 Japan .

*Primary Examiner*—Charles G. Freay
*Attorney, Agent, or Firm*—Brooks Haidt Haffner & Delahunty

[57] ABSTRACT

A piston, swash plate compressor has a rotary valve that rotates integrally with a main drive shaft. A chamber is provided, separated from the piston bores by a partition. Valved ports are formed in the partition. One end of the rotary valve contacts the partition. Compressed gas biases the rotary valve against the partition to improve sealing and thus, efficiency.

22 Claims, 9 Drawing Sheets

GAS SUCTION STRUCTURE IN PISTON TYPE COMPRESSOR

BACKGROUND OF THE INVENTION

1. Field of the Invention

The present invention relates to a piston type compressor. More specifically, the invention relates to a gas suction structure in a piston type compressor capable of efficiently compressing gas.

2. Description of the Related Art

Piston type compressors are generally used for air-conditioning passenger compartments in vehicles. In the typical compressor, a swash plate is supported on a drive shaft, and a piston is disposed in each cylinder bore a plurality of which are formed around the drive shaft. The rotation of the drive shaft is converted to reciprocating movement of each piston between a top dead center and a bottom dead center in each cylinder bore by the swash plate. With the reciprocating piston, refrigerant gas is sucked from a suction chamber and compressed in a compression chamber of the cylinder bore. Subsequently, the compressed gas is discharged to a discharge chamber.

A piston type compressor having a flapper type suction valve is known. This suction valve selectively opens and closes a suction port defined between each compression chamber and the suction chamber. In this compressor, the refrigerant gas in the suction chamber flows through the suction port, forces the suction valve open, and enters the cylinder bore when the piston is driven in a suction stroke from the top dead center to the bottom dead center. The suction valve closes the suction port when the piston is driven in a compression and discharge stroke from the bottom dead center to the top dead center. The compressed gas in the compression chamber is discharged to the discharge chamber through a discharge port.

The flapper type suction valve is normally closed. Therefore, in order to open the suction port, it is necessary to flex the suction valve against an elastic resistance. For this reason, unless a pressure difference between the compression chamber and the suction chamber is sufficient to overcome the elastic resistance, the suction valve is not opened. As a result, the timing at which the suction port is opened by the suction valve (hereinafter referred to as an open-timing) is delayed. Moreover, when the suction port is closed by the suction valve, the lubricating oil contained in the refrigerant gas adheres to the suction valve and the surrounding surface of the suction port that the suction valve contacts. This oil increases the adhesive force between the suction valve and the surface contacted by the suction valve. Consequently, the suction valve resists opening, and the open-timing of the suction port by the suction valve is further delayed. Such a delay of the open-timing reduces the amount of refrigerant gas that flows into the compression chamber. In other words, the delay reduces the volumetric efficiency of the compressor.

Japanese Unexamined Patent Publication No. Hei 5-231310 discloses a piston type compressor using a rotary valve instead of a flapper type suction valve. In this compressor, the rotary valve is used to improve the volumetric efficiency. The rotary valve is coupled to one end of a drive shaft so that it rotates together with the drive shaft and is located in a valve chamber formed in the cylinder block. Also, the rotary valve is provided with a suction passage, which has an inlet communicating with a suction chamber and an outlet open to the outer peripheral surface of the rotary valve. A suction port is formed between the valve chamber and the compression chamber of each cylinder bore. As the rotary valve is rotated, the outlet of the suction passage is connected in sequence with the suction ports of the compression chambers where a piston is in its suction stroke. As a result, the refrigerant gas within the suction chamber flows into the compression chamber through the suction passage and the suction port. Thus, in the compressor using the rotary valve, there is no need to push and open a flapper type suction valve when the refrigerant gas flows into the compression chamber from the suction chamber. Thus, the refrigerant gas is efficiently introduced into the compression chamber, avoiding a reduction in the volumetric efficiency.

However, if the seal between the outer peripheral surface of the rotary valve and the inner peripheral surface of the valve chamber retaining the rotary valve is poor, the refrigerant gas within the compression chamber where the piston is in the compression or discharge stroke will leak from between the outer peripheral surface of the rotary valve and the inner peripheral surface of the valve chamber through the suction port. In such a case, the volumetric efficiency will be reduced and thus the compressor will not run as efficiently. The seal between the outer peripheral surface of the rotary valve and the inner peripheral surface of the valve chamber depends only on the size of the clearance therebetween. Maintaining the size of this clearance to an appropriate size is very troublesome. In other words, it is very difficult to machine the rotary valve and the valve chamber such that the rotary valve rotates smoothly within the valve chamber while a minimal clearance is maintained to prevent refrigerant gas from leaking from between the peripheral surfaces. Moreover, when an external force, for example, acts on the compressor and the cylinder block is deformed, the clearance between the outer surface of the rotary valve and the inner surface of the valve chamber becomes larger at some locations and the seal therebetween is corrupted.

SUMMARY OF THE INVENTION

The objective of the present invention is to provide a gas suction structure in a piston type compressor which is capable of maintaining a high volumetric efficiency.

To achieve the above objects, the compressor according to the present invention has a drive plate mounted on a drive shaft in a housing, and a piston member coupled to the drive plate and disposed in a bore member. The rotation of the drive shaft is converted by the drive plate to a reciprocating movement of the piston member between a top dead center and a bottom dead center in the bore to compress gas. The gas is supplied from a suction chamber to the bore during a suction stroke in which the piston member is driven from the top dead center to the bottom dead center. The compressed gas is discharged from the bore to a discharge chamber during a compression and discharge strike in which the piston member is driven from the bottom dead center to the top dead center. A valve chamber is defined in the housing. A partition is disposed between the valve chamber and the bore. The partition has a port for connecting the valve chamber with the bore. A rotary valve is supported on the drive shaft for an integral rotation in the valve chamber. The rotary valve has a first end surface opposed to the partition. A suction passage is formed in the rotary valve for introducing the gas from the suction chamber to the bore. The suction passage has an outlet opening at the first end surface and communicating with the bore by way of the port according to the rotation of the rotary valve when the piston member is in the suction stroke. A biasing member urges the first end surface against the partition.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
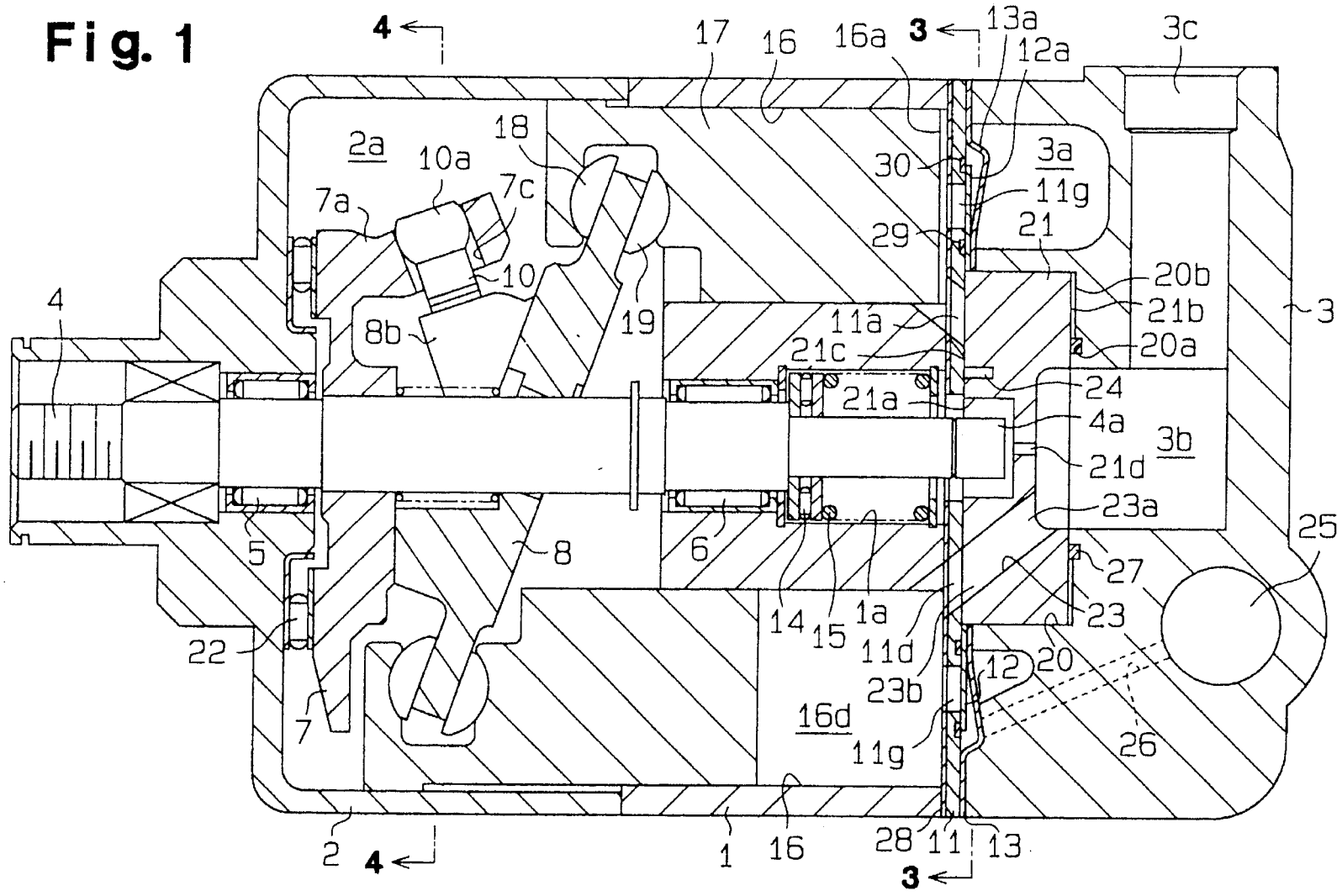
FIG. 1 is a cross-sectional side elevation view showing an overall compressor according to a first embodiment of the present invention.

A piston type compressor according to a first embodiment of the present invention will now be described with reference to FIGS. 1 through 5.

A cylinder block 1 constitutes a part of the housing of the compressor. A front housing 2 is fixed to the front end of the cylinder block 1. The front housing 2 defines a crank chamber 2*a*. A rear housing 3 is fixed to the rear end of the cylinder block 1 via a gasket 28, a first plate 11, a second plate 12 and a third plate 13. The third plate 13 functions as a gasket. A ring-like gasket 29 is disposed between the first plate 11 and the second plate 12. A ring-like gasket 30 is disposed between the first plate 11 and the third plate 13.

A drive shaft 4 is supported rotatably in the front housing 2 and the cylinder block 1 by a pair of radial bearings 5 and 6. A hole 1*a* is formed in the center portion of the cylinder block 1. The hole 1*a* is concentric with the axis of the drive shaft 4. The hole 1*a* communicates with the crank chamber 2*a* through the radial bearing 6.

Figure 4:
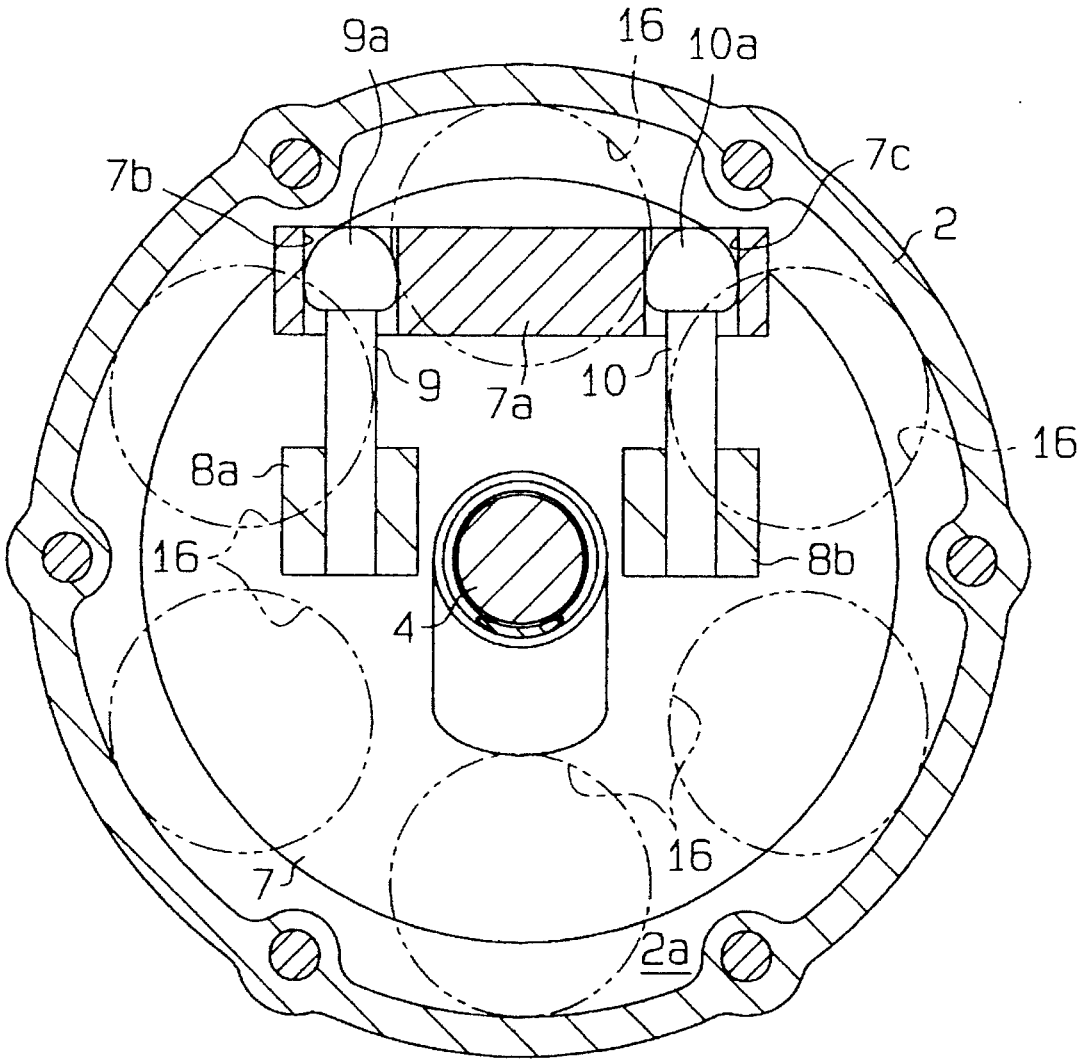
FIG. 4 is a cross-sectional view taken along a line 4—4 of FIG. 1.

A swash plate 8 is supported by the drive shaft 4 in such a way as to be slidable along and tiltable with respect to the axis of this shaft 4. As shown in FIGS. 1 and 4, a pair of stays 8*a* and 8*b* are secured to the swash plate 8. Guide pins 9 and 10 are fixed to the respective stays 8*a* and 8*b*. Guide balls 9*a* and 10*a* are formed at the distal ends of the respective guide pins 9 and 10. A rotary plate 7 is fixed to the drive shaft 4. The rotary plate 7 has a support arm 7*a* protruding toward the swash plate 8 (rearward) from the rotary plate 7. A pair of guide holes 7*b* and 7*c* are formed in the arm 7*a*, and the guide balls 9*a* and 10*a* are slidably fitted in the associated guide holes 7*b* and 7*c*. The cooperation of the arm 7*a* and the guide pins 9 and 10 permits the swash plate 8 to rotate together with the drive shaft 4 and to tilt with respect to the drive shaft 4.

As shown in FIG. 1, a thrust bearing 22 is disposed between the rotary plate 7 and the front housing 2. A thrust bearing 14 is disposed in the hole 1*a*. A compressed coil spring 15 is dsposed in the hole 1*a*. The coil spring 15 applies an axial pre-load to the drive shaft 4 via the thrust bearing 14. This pre-load is received by the front housing 2 via the drive shaft 4, the rotary plate 7 and the thrust bearing 22. The coil spring 15 prevents the drive shaft 4 from being rattled in a thrust direction.

A plurality of cylinder bores 16 are formed in the cylinder block 1 at equal intervals about the axis of the drive shaft 4. Single-headed pistons 17 are retained in the associated cylinder bores 16. Hemispherical portions of a pair of shoes 18 and 19 are fitted on each piston 17 in a slidable manner. The swash plate 8 is held between the flat portions of both shoes 18 and 19. Accordingly, undulation of the swash plate 8 caused by the rotation of the drive shaft 4 is transmitted via the shoes 18 and 19 to each piston 17, so that the piston 17 reciprocates in the associated cylinder bore 1*a* in accordance with the inclination of the swash plate 8.

Figure 3:
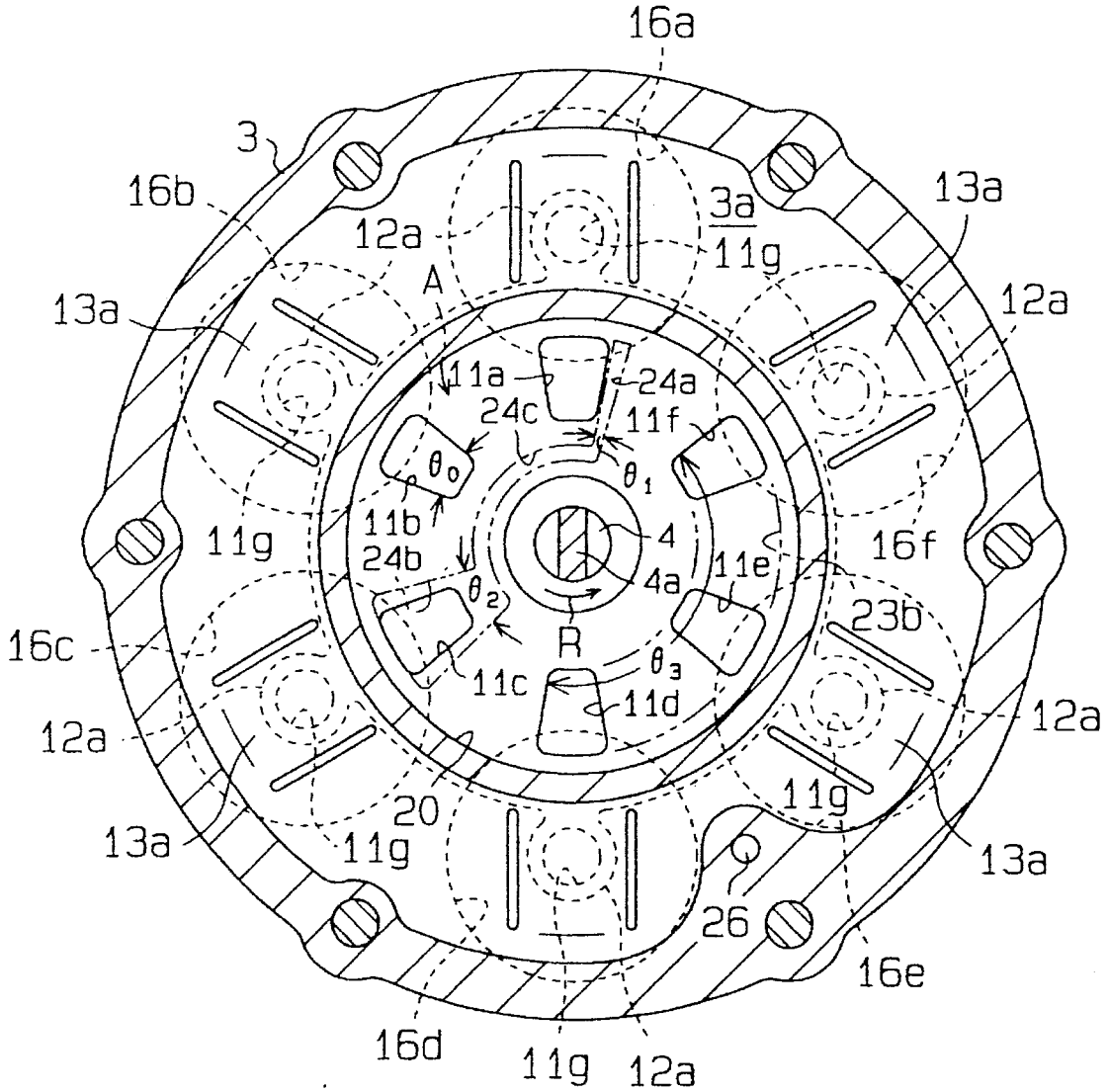
FIG. 3 is a cross-sectional view taken along a line 3—3 of FIG. 1.

As shown in FIGS. 1 and 3, a suction chamber 3*b* is formed in the central portion of the rear housing 3. To this suction chamber 3*b*, refrigerant gas is introduced from an external refrigeration circuit (not shown) through an inlet port 3*c*. A discharge chamber 3*a* is formed in the rear housing 3 around the suction chamber 3*b*. From this discharge chamber 3*a*, the refrigerant gas introduced into the suction chamber 3*b* is returned to the external refrigeration circuit through an outlet port (not shown). Compression chambers 16*a*, 16*b*, 16*c*, 16*d*, 16*e*, and 16*f* formed in cylinder bores 16 by the piston 17 are partitioned from the discharge chamber 3*a* by the first plate 11. A discharge port 11*g* is formed in the first plate 11. A flapper type discharge valve 12*a* is formed in the second plate 12. A retainer 13*a* is formed in the third plate 13. The discharge valve 12*a* opens and closes the discharge port 11 at the side of the discharge chamber 3*a*. The retainer 13*a* regulates the degree of opening of the discharge valve 12*a*.

Figure 2:
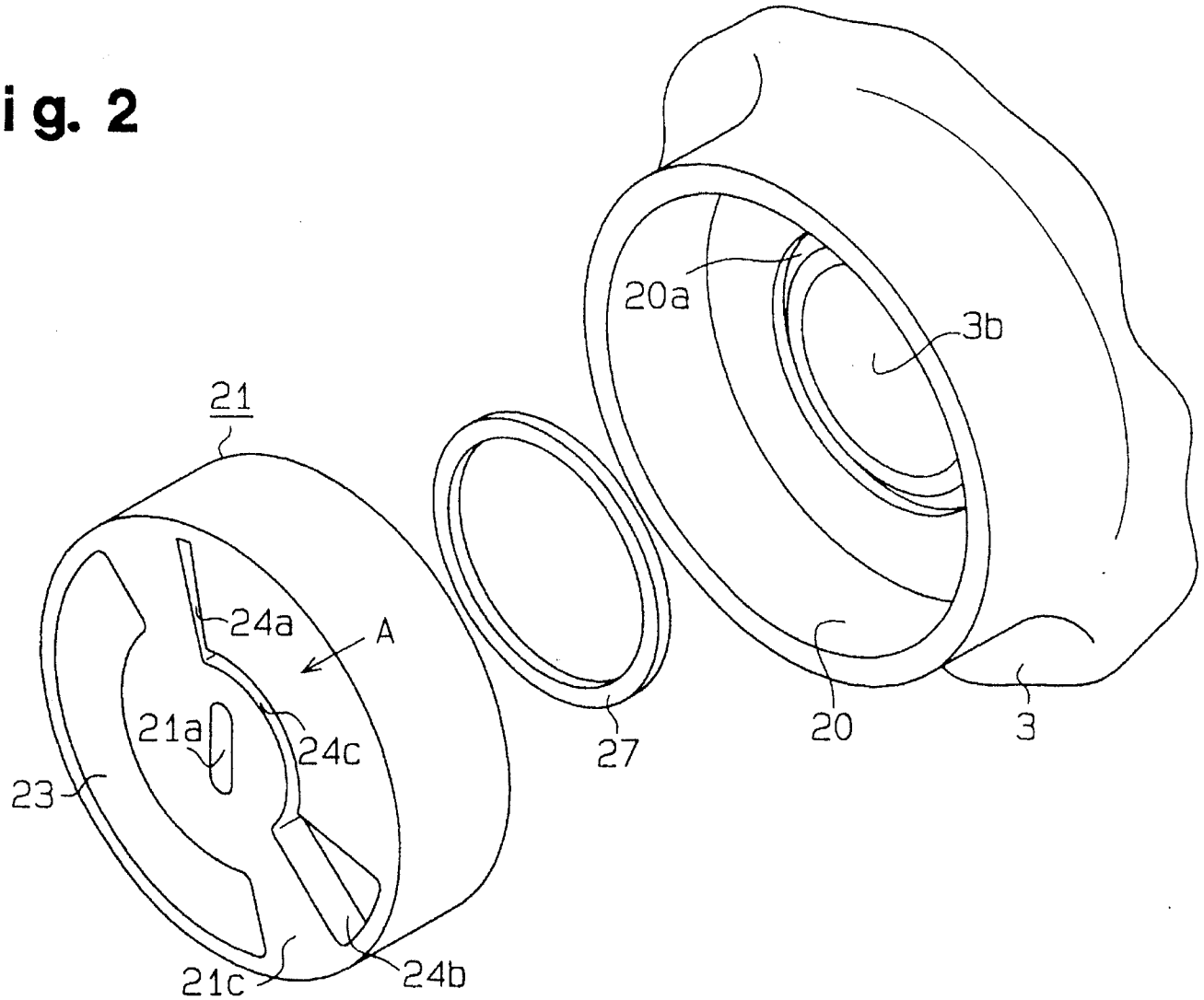
FIG. 2 is an exploded perspective view showing essential parts of the compressor of FIG. 1.

As shown in FIGS. 1 through 3, a valve chamber 20 is formed in the central portion of the rear housing 3 and communicates with the suction chamber 3*b*. A cylindrical rotary valve 21 is rotatably retained in the valve chamber 20. A slot 21*a* is formed in the central portion of the front end face 21*c* (the face contacting valve plate 11) of the rotary valve 21. The slot 21*a* extends in the diametric direction of the rotary valve 21, as shown in FIG. 2. The center axis of the rotary valve 21 is substantially aligned with that of the drive shaft 4. The rear end portion 4*a* of the drive shaft 4 extends into the valve chamber 20 and is fitted into the slot 21*a*. The rear end portion 4*a* of the drive shaft 4 has room to move in the lengthwise direction of the slot 21*a* as seen in FIG. 1. The rotation of the drive shaft 4 is transmitted to the rotary valve 21 by the engagement of the end portion 4*a* with the slot 21*a*, so that the rotary valve 21 is rotated together with the drive shaft 4.

If the center axis of the drive shaft 4 and the center axis of the rotary valve 21 are slightly offset from each other due to an assembly error, the end portion 4*a* of the drive shaft 4 and the recess portion 21*a* of the rotary valve 21 slide relatively, thus compensating for the offset. In such a case, the rotary valve 21 rotates on its axis while slightly orbiting around the center axis of the shaft 4. Therefore, the clearance between the inner surface of the valve chamber 20 and the outer surface of the rotary valve 21 is set in consideration of an offset between the axes of the drive shaft 4 and the rotary valve 21.

A suction passage 23 is formed in the rotary valve 21 and extends in the circumferential direction of the rotary valve 21. The suction passage 23 has an inlet 23*a* which is open to the rear end face 21*b* of the rotary valve 21 and an outlet 23*b* which is open to the front end face 21*c*. The inlet 23*a* of the suction passage 23 communicates with the suction chamber 3*b*. The front end face 21*c* of the rotary valve 21 slidably contacts the first plate 11. The first plate 11, therefore, serves as a valve seat for the rotary valve 21. Suction ports 11*a* to 11*f* are formed in the first plate 11 to communicate the compression chambers 16*a* to 16*f* with the valve chamber 20. The suction ports 11*a* to 11*f* are arranged in a circular pattern to align with the outlet 23*b* of the suction passage 23 at the appropriate time.

During the suction stroke when the piston 17 moves from its top dead center to its bottom dead center, the compression chambers 16*a* to 16*f* are communicated with the outlet 23*b* of the suction passage 23 through the suction ports 11*a* to 11*f*, as the rotary valve 21 is rotated. Therefore, the refrigerant gas within the suction chamber 3*b* passes through the suction passage 23 and the suction ports 11*a* to 11*f* and flows into the compression chambers 16*a* to 16*f*. In FIG. 3, the piston 17 within the compression chamber 16*a* is at the top dead center, while the piston 17 within the compression chamber 16*d* is at the bottom dead center. The drive shaft 4 rotates in the direction indicated by arrow R.

A capture groove 24 is formed in the front end face 21*c* of the rotary valve 21. The capture groove 24 is arranged on the opposite side of the suction passage 23 from the suction passage 23. The capture groove 24 is provided with an inlet groove 24*a*, an outlet groove 24*b*, and a bypass groove 24*c*, as shown in FIGS. 2 and 3. The inlet and outlet grooves 24*a* and 24*b* extend in the radial direction of the rotary valve 21 and are spaced about a half-circumference apart. The bypass groove 24*c* extends along the circumferential direction of the rotary valve 21 so that the inlet groove 24*a* and the outlet groove 24*b* are connected at their inner ends. The inlet and outlet grooves 24*a* and 24*b* are communicated in sequence with the suction ports 11*a* to 11*f* as the rotary valve 21 is rotated.

As shown in FIG. 3, the inlet groove 24*a* extends in the circumferential direction of the rotary valve 21 by an angle $\theta_1$ with respect to the center axis of the rotary valve 21. The outlet groove 24*b* extends in the circumferential direction of the rotary valve 21 by an angle $\theta_2$ with respect to the center axis of the rotary valve 21. The angle $\theta_1$ is smaller than $\theta_2$. In other words, the circumferential width of the inlet groove 24*a* is smaller than that of the outlet groove 24*b*. Also, each of the suction ports 11*a* to 11*f* extends in the circumferential direction of the rotary valve 21 by an angle $\theta_0$ with respect to the center axis of the rotary valve 21. The angle $\theta_2$ is greater than $\theta_0$. In other words, the circumferential width of the outlet groove 24*b* is greater than that of each of the suction ports 11*a* to 11*f*. The outlet 23*b* of the suction passage 23 extends in the circumferential direction of the rotary valve 21 by an angle $\theta_3$ with respect to the center axis of the rotary valve 21. The angle $\theta_3$ is a little less than 180 degrees.

A pressure release passage 21*d* is formed in the vicinity of the center axis of the rotary valve to communicate the support bore 1*a* with the suction chamber 3*b*. The pressure release passage 21*d* serves as a restriction passage.

The front end face 21*c* of the rotary valve 21 has an area-A enclosed by the capture groove 24, as shown in FIG. 2. During the compression and discharge stroke when the piston 17 moves from the bottom dead center to the top dead center, the suction ports 11*a* to 11*f* are closed by the area-A as the rotary valve 21 is rotated. With this, the compression chambers 16*a* to 16*f* and the suction passage 23 are disconnected and the refrigerant gas within the compression chambers 16*a* to 16*f* is compressed by the piston 17. Thereafter, the compressed gas within the compression chambers 16*a* to 16*f* pushes and opens the discharge valve 12*a*, from the discharge port 11*g*, and is discharged into the discharge chamber 3*a*.

The angle of inclination of the swash plate 8 changes according to a difference between the pressure within the crank chamber 2*a* and the pressure within the compression chambers 16*a* to 16*f*. As the angle of inclination of the swash plate 8 changes, the amount of movement of the piston 17 changes. The refrigerant gas within the discharge chamber 3*a* is supplied to the crank chamber 2*a* via a displacement control valve 25 responsive to a suction pressure and a supply passage 26. The refrigerant gas within the crank chamber 2*a* is discharged to the suction chamber 3*b* via the support bore 1*a* and the pressure release passage 21*d*. If the degree of opening of the displacement control valve 25 changes in response to a suction pressure, an amount of refrigerant gas to be supplied to the crank chamber 2*a* from the discharge chamber 3*a* will change. With this change, the pressure within the crank chamber 2*a* is controlled.

An annular groove 20*a* is formed in the inner rear surface of the valve chamber 20 so that it surrounds the suction chamber 3*b*. An annular seal 27 is fitted in the annular groove 20*a*. Between the rear end face 21*b* of the rotary valve 21 and the inner rear surface of the valve chamber 20, a pressure area 20*b* is formed. The pressure area 20*b* communicates with the suction ports 11*a* to 11*f* through the clearance between the outer surface of the rotary valve 21 and the inner surface of the valve chamber 20, and through the slight clearance between the front end face 21*c* of the rotary valve 21 and the first plate 11.

As described above, in the compressors using a flapper type suction valve, it is necessary to flex the suction valve against its own elastic resistance to cause the suction valve to open. However, the lubricating oil contained in the refrigerant gas increases an adhesive force between the suction valve and a surface that the suction valve contacts. As a result, the open-timing of the suction valve is delayed and the volumetric efficiency is reduced. On the other hand, in the compressor using the rotary valve 21, a problem such as that caused by the above-described flapper type valve does not occur, and when the suction passage 23 communicates with the suction ports 11*a* to 11*f*, the refrigerant gas within the suction chamber 3*b* will flows immediately into the compression chambers 16*a* to 16*f*. Therefore, unless the refrigerant gas within the compression chambers 16*a* to 16*f*, where the piston 17 is in the compression or discharge stroke, leaks into a low pressure area (such as the crank chamber 2*a* or the suction chamber 3*b* via the suction ports 11*a* to 11*f*), the volumetric efficiency is greatly enhanced.

The suction ports 11*a* to 11*f* of the compression chambers 16*a* to 16*f* are closed by the area-A of the front end face 21*c* of the rotary valve 21 so that the compression chambers 16*a* to 16*f* and the suction passage 23 are disconnected. The refrigerant gas within the compression chambers 16*a* to 16*f* and the suction ports 11*a* to 11*f*, therefore, is compressed by the piston 17. At this time, a gasket 28 between the first plate 11 and the cylinder block 1 prevents the compressed refrigerant gas from leaking to the hole 1*a* from the suction ports 11*a* to 11*f*.

Figure 5:
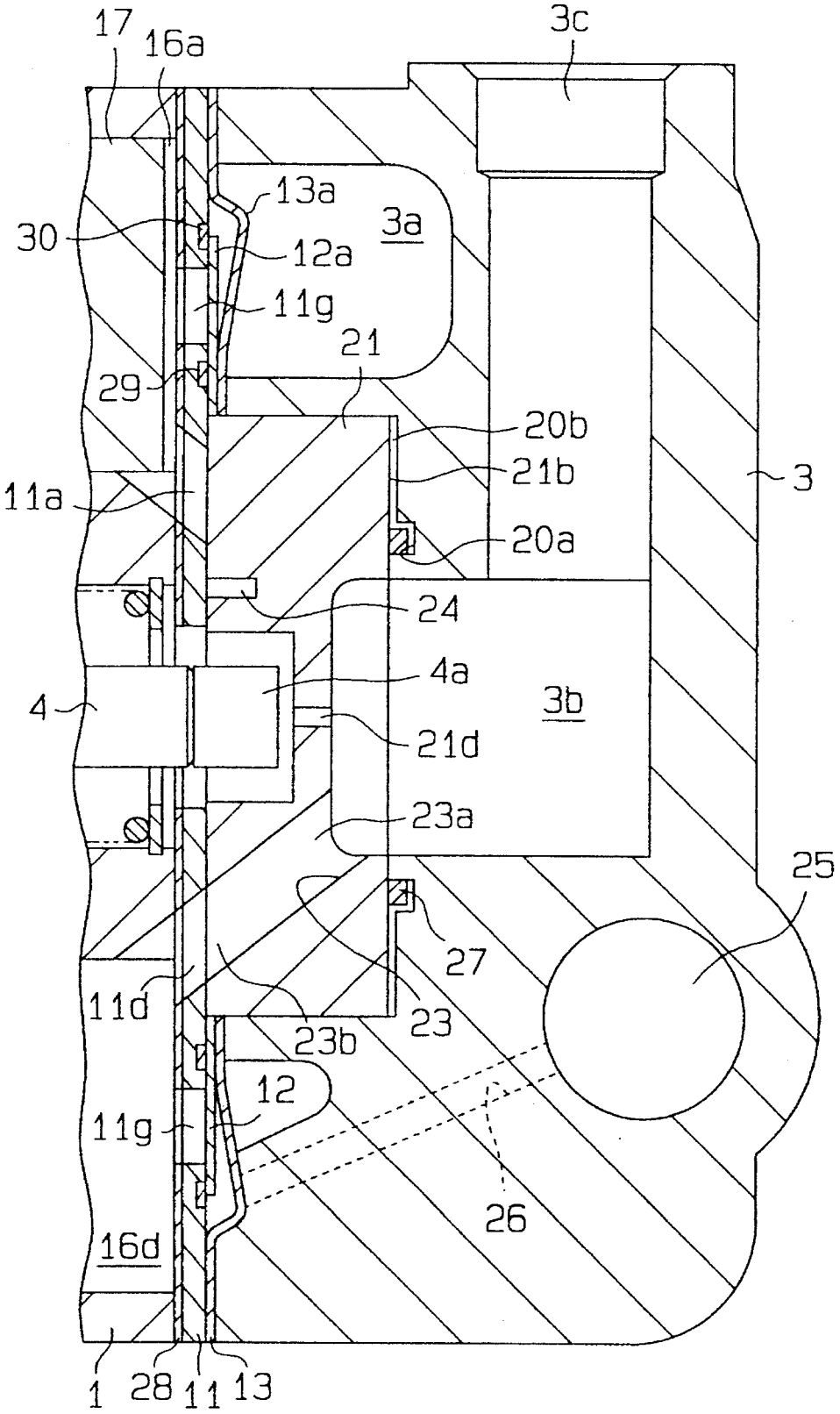
FIG. 5 is an enlarged side cross-sectional view showing essential parts of the compressor.
Figure 6:
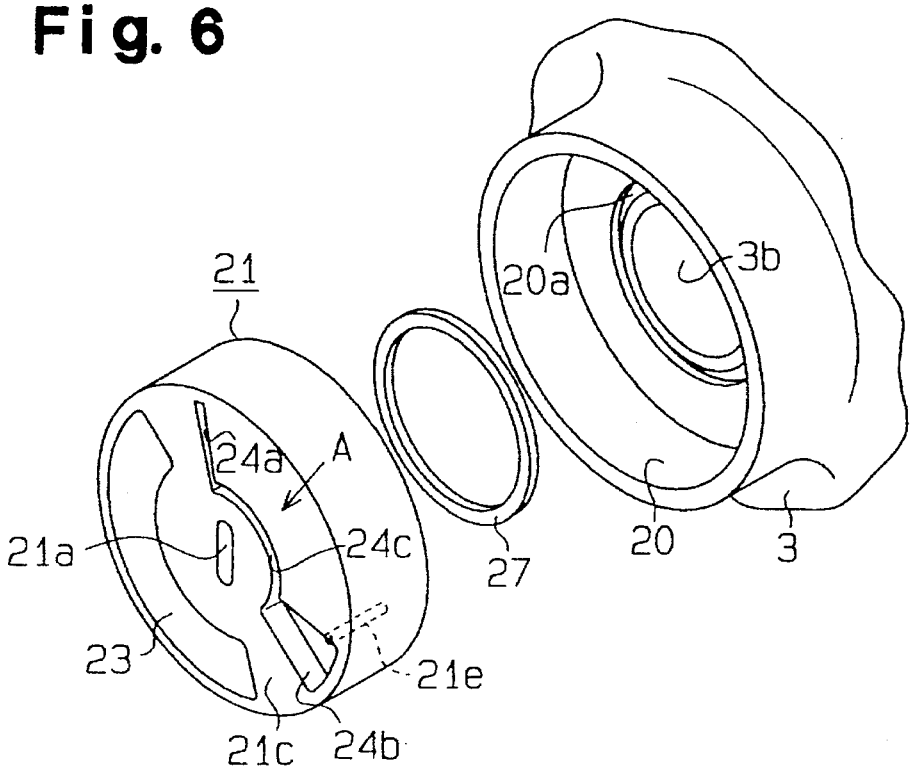
FIG. 6 is an exploded perspective view showing essential parts of a compressor according to a second embodiment.

An appropriate clearance is provided between the outer surface of the rotary valve 21 and the inner surface of the valve chamber 20 so that the rotary valve 21 can be easily fitted into the valve chamber 20 and smoothly rotated within the valve chamber 20. The front end face 21*c* of the rotary valve 21 and the first plate 11 are in surface contact with each other, however, there exists a microscopic clearance between the front end face 21*c* of the rotary valve 21 and the first plate 11. Therefore, the highly compressed refrigerant gas within the suction ports 11*a* to 11*f* leaks to the pressure area 20*b* through the clearance between the front end face 21*c* of the rotary valve 21 and the first plate 11 and the clearance between the outer peripheral surface of the rotary valve 21 and the inner peripheral surface of the valve chamber 20. The third plate 13, serving also as a gasket, and the gasket 29 reliably disconnect the discharge chamber 3*a* and the valve chamber 20. The highly compressed refrigerant gas that leaks to the pressure area 20*b*, as shown in FIG. 5, presses the seal 27 toward the rear end face 21*b* of the rotary valve 21 and the inner circumferential face of the groove 20*a* and holds it tightly against those faces. With this seal, the pressure area 20*b* and the suction chamber 3*b* are reliably disconnected. The pressure within the pressure area 20*b* is the pressure of the refrigerant gas that leaks to the pressure area 20*b* from the suction ports 11*a* to 11*f*.

The refrigerant gas leaking toward portions other than the outer peripheral surface of the rotary valve 21 from the suction ports 11*a* to 11*f* is captured by the capture groove 24. The refrigerant gas captured by the capture groove 24 flows into the compression chambers 16*a* to 16*f*, where the piston 17 is in the compression stroke, through the outlet groove 24*b* and the suction ports 11*a* to 11*f*. Therefore, there is no possibility that the refrigerant gas that leaks from the suction ports 11*a* to 11*f* flows into the outlet 23*b* of the suction passage 23. If the gas that leaks flows into the suction passage 23, the amount of the refrigerant gas within the compression chambers 16*a* to 16*f* will be reduced by the amount of the gas that flowed, and the volumetric efficiency will be reduced. However, if the gas that leaks is sent to the compression chambers 16*a* to 16*f*, where the piston 17 is in the compression stroke, through the capture groove 24, there will be no possibility that the amount of the refrigerant gas within the compression chambers 16*a* to 16*f* will be reduced. Therefore, there is no possibility that leakage of refrigerant gas from the suction ports 11*a* to 11*f* will cause a reduction in the volumetric efficiency.

In the rear end face 21*b* of the rotary valve 21, the portion within the pressure area 20*b* that is subjected to the pressure of the gas that leaks is a portion between the outer circumferential edge of the rear end face 21*b* and the inner circumferential edge of the groove 20*a*. The area of the portion that is subjected to that pressure is assumed to be $S_1$. In the front end face 21*c* of the rotary valve 21, the area that is subjected to the pressure of the refrigerant gas that leaks is the sum of the area of the capture groove 24 and the area-A enclosed by the capture groove 24 at the maximum. The area that is subjected to that pressure is assumed to be $S_2$. In this embodiment, $S_1$ is greater than $S_2$. If the pressure of the gas that leaks is assumed to be Pe, the load acting on the rear end face 21*b* of the rotary valve 21 ($Pe \cdot S_2$) will be greater than the load acting on the front end face 21*c* of the rotary valve 21 ($Pe \cdot S_2$). As a result, the rotary valve 21 is pushed against the first plate 11 with a load Pe ($S_1 - S_2$). When the sealing performance between the front end face 21*c* and the first plate 11 is low, the refrigerant gas within the capture groove 24 and the refrigerant gas that leaks between the outer peripheral surface of the rotary valve 21 and the inner peripheral surface of the valve chamber 20 flows into the suction passage 23 through the outlet 23*b* from between the front end face 21*c* and the first plate 11, and the volumetric efficiency is reduced. However, if the front end face 21*c* of the rotary valve 21 is pushed against the first plate 11 with the pressure of the gas that leaks, the sealing performance between the front end face 21*c* and the first plate 11 will be improved.

The front end face 21*c* of the rotary valve 21 and the first plate 11 are in flat surface contact with each other. Accordingly, a high sealing performance therebetween can be achieved more easily in comparison with other cases such as where the contacting surfaces are curved.

If the rotary valve is formed a chamber in the cylinder block, the portion between the valve chamber and the cylinder bore will become thin and the cylinder block will be easy to deform. If the cylinder block is deformed, the valve chamber will also be deformed. Then, the sealing performance between the rotary valve and the valve chamber will be reduced or the parts may be burnt together. In addition, the deformation of the cylinder bore causes refrigerant gas to leak from between the outer peripheral surface of the piston and the inner peripheral surface of the cylinder bore or, the piston will not be able to slide smoothly within the cylinder bore. The structure where the chamber 20 that retains the rotary valve 20 is formed in the rear housing 3 is advantageous in that the strength of the cylinder block 1 is ensured. Therefore, the problem caused by the deformation of the cylinder block is overcome.

The first plate 11 serves as a valve seat for the rotary valve 21. In such a structure, the size of the diameter of the rotary valve 21 is limited by the position and arrangement of the discharge port 11*g* formed in the first plate 11. It is, however, possible to form the rotary valve 21 of a size that the outer peripheral edge thereof and the cylinder bore 16 overlap in the axial direction of the rotary valve 21. Therefore, in comparison with the case where the cylinder block 1 is used as the seat of the rotary valve 21, the diameter of the rotary valve 21 can be made larger and the area of the front end face 21*c* contacting the first plate 11 can be made larger. An increase in this contact area enhances the sealing performance between the first plate 11 and the front end face 21*c*.

When the inlet groove 24*a* of the capture groove 24 is, for example, with the suction port 11*a* of the compression chamber 16*a*, the outlet groove 24*b* communicates with the suction port 11*c* of the compression chamber 16*c*. When the piston 17 is moved to the top dead center, the volume of each of the compression chambers 16*a* to 16*f* is not zero, and the compressed refrigerant gas remains in the compression chambers 16*a* to 16*f*. The refrigerant gas, which remains within the compression chamber 16*a* immediately after the suction stroke of the piston 17, flows into the compression chamber 16*c* where the piston 17 is in the compression stroke through the capture groove 24. If the compressed refrigerant gas remains within the compression chamber 16*a*, where the piston 17 is in the suction stroke, an amount of refrigerant gas equivalent to this remaining refrigerant gas will not be able to be sucked in, and the volumetric efficiency will be reduced. In this embodiment, the refrigerant gas remaining within the compression chamber immediately after the suction stroke of the piston 17 flows into another compression chamber where the piston 17 is in the compression stroke, and thus this gas is compressed. Consequently the volumetric efficiency is enhanced.

The width of the inlet groove 24*a* in the circumferential direction of the rotary valve 21 is made as small as possible as compared with each of the suction ports 11*a* to 11*f*. If the width of the inlet groove 24*a* is smaller, the timing at which the communication between the inlet groove 24*a* and each of the suction ports 11*a* to 11*f* ends will be earlier. As a result, during the suction strokes, the pressure within each of the compression chambers 16*a* to 16*f* is immediately lower than the pressure within the suction passage 23. Therefore, when the suction passage 23 and the compression chambers 16*a* to 16*f* are connected, the refrigerant gas within the suction chamber 3*b* flows immediately into the compression chambers 16*a* to 16*f*. The width of the inlet groove 23*a* influences the volumetric efficiency, and if the width is smaller, the volumetric efficiency will be improved.

If the width of the inlet groove 24*a* is small, however, it will be difficult to smoothly discharge the remaining gas within the compression chambers 16*a* to 16*f*. In order to smoothly discharge the remaining gas within the compression chambers 16*a* to 16*f*, it is necessary to make the pressure within the capture groove 24 sufficiently low. In other words, making the pressure within the capture groove 24 low is necessary when the width of the inlet groove 24*a* is small. If the period during which the outlet groove 24*b* and each of the suction ports 11*a* to 11*f* are in communication is increased, the pressure within the capture groove 24 can be reliably kept low. If the width of the outlet groove 24*b* in the circumferential direction of the rotary valve 21 is increased, the period during which the outlet groove 24*b* and each of the suction ports 11*a* to 11*f* communicate will be increased.

A description will hereinafter be given of another embodiment of the present invention in accordance with FIGS. 6 to 11. In a second embodiment shown in FIG. 6, a rotary valve 21 is provided with an introduction passage 21*e*. The introduction passage 21*e* has an inlet open to the bottom surface of an outlet groove 24*b* and an outlet open to the rear end face 21*b* of the rotary valve 21. The refrigerant gas within a capture groove 24 is introduced to a pressure area 20*b* through the introduction passage 21*e*. Since the pressure within the capture groove 24 is lower than that of the gas leaking from suction ports 11*a* to 11*f*, the pressure within the pressure area 20*b* does not become excessive. If the pressure within the pressure area 20*b* is too high, the slide resistance between the front end face 21*c* of the rotary valve 21 and the first plate 11 will become excessive and the power loss of the compressor will increase unacceptably.

Figure 7:
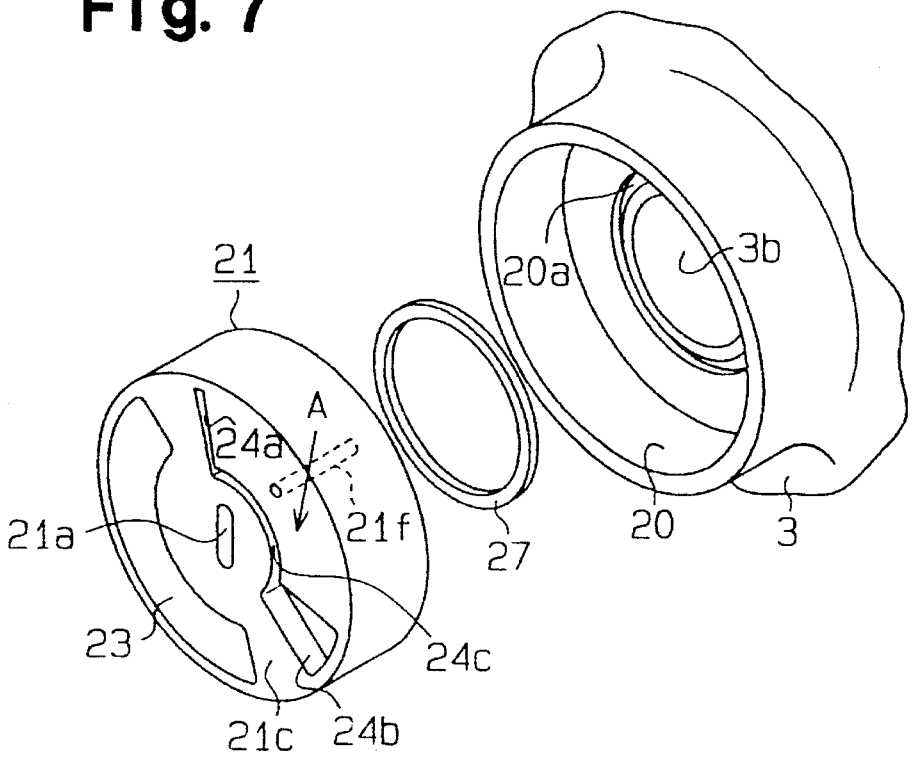
FIG. 7 is an exploded perspective view showing essential parts of a compressor according to a third embodiment.

In a third embodiment of the present invention shown in FIG. 7, an introduction passage 21*f* formed in a rotary valve 21 has an inlet open to the area-A of the front end face 21*c* of the rotary valve 21 and an outlet open to the rear end face 21*b* of the rotary valve 21. The introduction passage 21*f* communicates with the suction ports 11*a* to 11*f* of the compression chambers 16*a* to 16*f* when a piston 17 is in its compression stroke. Therefore, the refrigerant gas within the compression chamber, where the piston 17 is in its compression stroke, is introduced into a pressure area 20*b* through the introduction passage 21*f*. Since the pressure of the refrigerant gas in the compression stroke is lower than that of the gas leaking from the suction ports 11*a* to 11*f*, the pressure within the pressure area 20*b* is not excessive.

Figure 8:
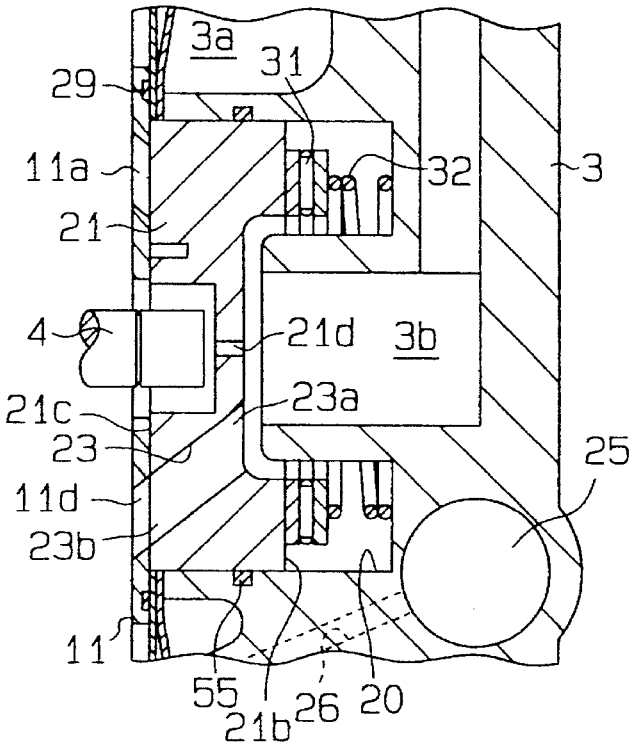
FIG. 8 is an enlarged partial side cross-sectional view showing essential parts of a compressor according to a forth embodiment.

In a fourth embodiment of the present invention shown in FIG. 8, a thrust bearing 31 and a coil spring 32 are arranged between the bottom surface of a valve chamber 20 and the rear end face 21*b* of a rotary valve 21. Between the outer peripheral surface of the rotary valve 21 and the inner peripheral surface of the valve chamber 20, a seal ring 55. The coil spring 32 pushes the rotary valve 21 against the first plate 11 through the thrust bearing 31. Consequently, the sealing performance between the front end face 21*c* of the rotary valve 21 and the first plate 11 is enhanced.

Figure 9:
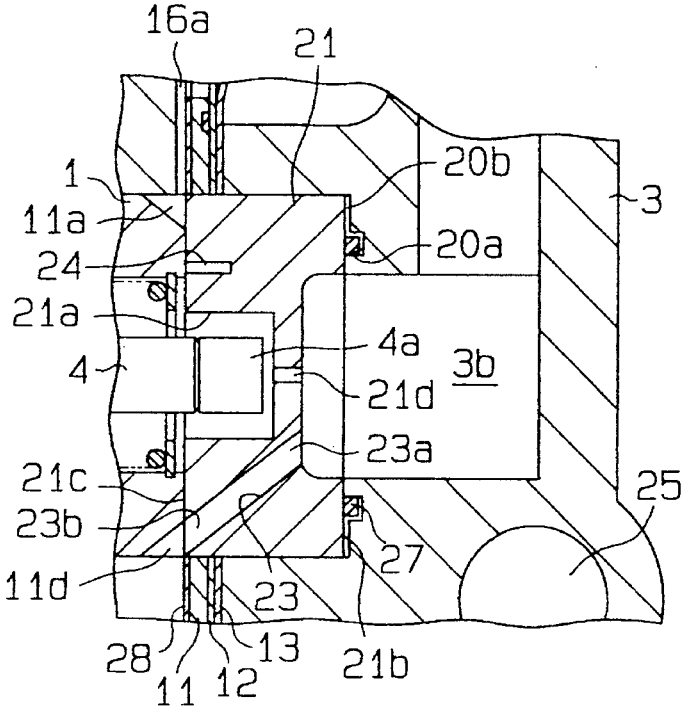
FIG. 9 is an enlarged partial side cross-sectional view showing essential parts of a compressor according to a fifth embodiment.

In a fifth embodiment of the present invention shown in FIG. 9, a cylinder block 1 serves as a valve seat for a rotary valve 21, and the front end face 21*c* of the rotary valve 21 is in contact with the end face of the cylinder block 1. In this arrangement, the diameter of the rotary valve 21 is limited by the position of a cylinder bore 16. In other words, it is necessary to form the rotary valve 21 to such a size that the outer peripheral edge thereof does not overlap with the cylinder bore 16 in the axial direction of the rotary valve 21. Consequently, the area of the front end face 21*c* of the rotary valve 21 is smaller than that of the first embodiment. However, the central portion of a valve plate 11 corresponding to the front end face 21*c* of the rotary valve 21 can be saved, and moreover, the length of a rear housing 3 can be made shorter. As a result, the entire compressor becomes light in weight, as compared with that of the first embodiment.

Figure 10:
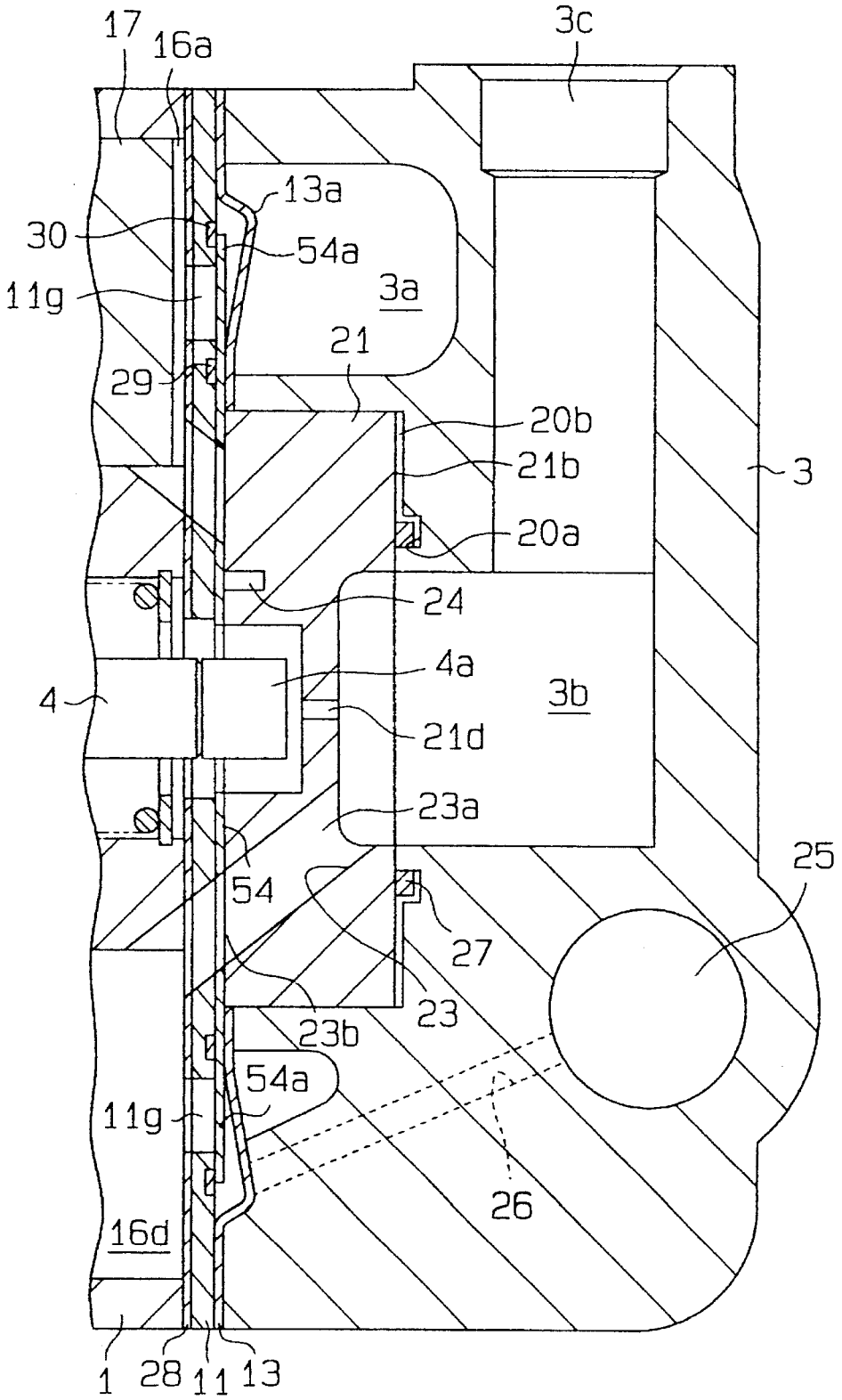
FIG. 10 is an enlarged partial side cross-sectional view showing essential parts of a compressor according to a sixth embodiment.

In a sixth embodiment of the present invention shown in FIG. 10, a second plate 54 serves as a valve seat for a rotary valve 21, and the front end face 21*c* of the rotary valve 21 is in contact with the second plate 54. The second plate 54 has a deformable discharge valve 54*a* and is made of iron. If the rotary valve 21 is made of aluminum to reduce the weight thereof, the rotary valve 21 will contact a different kind of metal. The contact between metals of different kinds is more effective in preventing burning than the contact between metals of the same kind.

Figure 11:
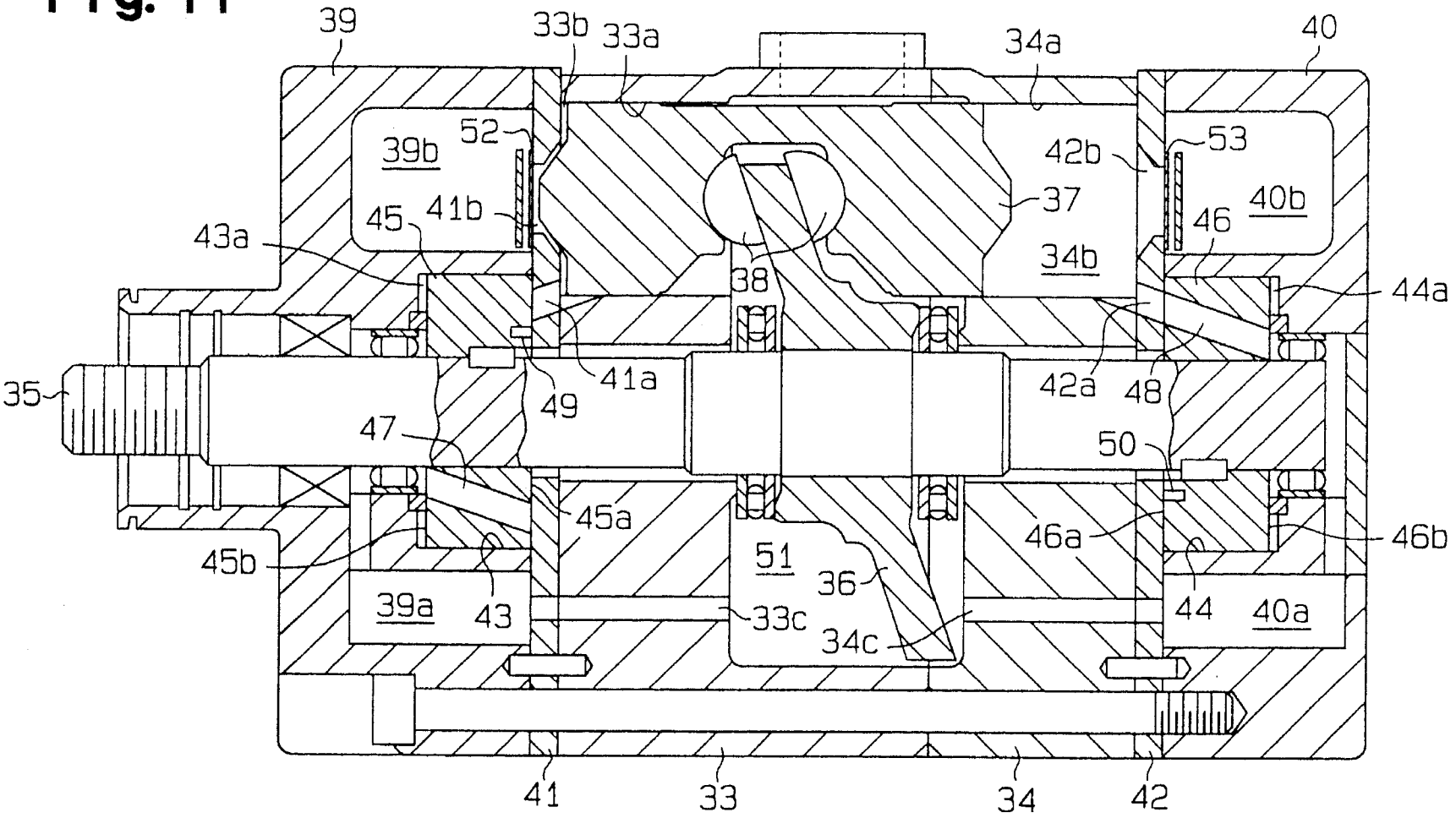
FIG. 11 is a cross-sectional side elevation view showing an overall compressor according to a seventh embodiment.

In a seventh embodiment of the present invention shown in FIG. 11, a pair of cylinder blocks 33 and 34 are clamped and fixed. A front housing 39 and a rear housing 40 are coupled to the cylinder blocks 33 and 34 through plates 41 and 42, respectively. A drive shaft 35 is rotatably supported by both housings 39 and 40. A swash plate 39 is fixed to the drive shaft 35. A plurality of pairs of cylinder bores 33*a* and 34*a* (in FIG. 11, only one pair is shown) are arranged around the drive shaft 35. A double-headed piston 37 is received in each pair of cylinder bores 33*a* and 34*a*. The piston 37 forms compression chambers 33*b* and 34*b* in the cylinder bores 33*a* and 34*a*. The rotary motion of the swash plate 36 is converted into reciprocating motion of the piston 37.

The housings 39 and 40 have suction chambers 39*a*, 40*a* and discharge chambers 39*b*, 40*b* formed therein, respectively. Valve chambers 43 and 44 are formed in the central portions of the housings 39 and 40, respectively. The valve chambers 43 and 44 are in communication with the suction chambers 39*a* and 40*a*, respectively. Rotary valves 45 and 46 are rotatably retained in the valve chambers 43 and 44. The rotary valves 45 and 46 are coupled to the drive shaft 35 so that they are slidable in the axial direction of the shaft 35 but cannot be rotated with respect to the shaft 35.

The rotary valves 45 and 46 are identical in structure with that of the first embodiment. The rotary valves 45 and 46 are provided with suction passages 47 and 48. The rotary valve 45 is formed at one end face thereof 45*a* with a capture groove 49, and a pressure area 43*a* is formed between the other end face 45*b* and the bottom surface of the valve chamber 43. Likewise, the rotary valve 46 is formed at one end face thereof 46*a* with a capture groove 50, and a pressure area 44*a* is formed between the other end face 46*b* and the bottom surface of the valve chamber 44.

The refrigerant gas from the external refrigeration circuit (not shown) is introduced into a crank chamber 51 within the cylinder blocks 33 and 34. The refrigerant gas within the crank chamber 51 flows into the suction chambers 39*a* and 40*a* through passages 33*c* and 34*c*. The refrigerant gas within the compression chambers 33*b* and 34*b* pushes and opens discharge valves 52 and 53 from the discharge ports 41*b* and 42*b* formed in the plates 41 and 42, and is discharged into the discharge chambers 39*b* and 40*b*.

The gas leaking from the suction ports 41*a* and 42*b* is introduced into the pressure areas 43*a* and 44*a*. The pressure of the gas within the pressure areas 43*a* and 44*a* causes the end faces 45*a* and 46*a* of the rotary valves 45 and 46 to be pushed against the plates 41 and 42.

The seventh embodiment also enhances the sealing performance and the strength of the cylinder blocks 33 and 34, and consequently, has the same advantages as the first embodiment.

In the present invention, the third plate with a retainer may be used as a seat valve for the rotary valve, or the end face of the rotary valve may be formed into a tapered shape in the form of a projection or recess.

Therefore, the present embodiments are to be considered as illustrative and not restrictive and the invention is not to be limited to the details given herein, but may be modified within the scope of the appended claims.

What is claimed is:

1. A compressor comprising a housing, a drive plate mounted on a drive shaft in said housing, a first piston coupled to the drive plate and disposed in a first cylinder bore in said housing, a suction chamber and a discharge chamber in said housing, wherein the rotation of the drive shaft is converted by the drive plate to a reciprocating movement of the first piston between a top dead center and a bottom dead center in the first bore to compress gas supplied from said suction chamber to the first bore during a suction stroke in which said first piston is driven from the top dead center to the bottom dead center, and wherein the compressed gas is discharged from the first bore to said discharge chamber during a compression and discharge stroke in which said first piston is driven from the bottom dead center to the top dead center, said compressor further comprising:

a valve chamber defined in said housing;

a partition for partitioning said valve chamber from said first bore, said partition having a first port for connecting said valve chamber with said first bore;

a rotary valve supported on said drive shaft for integral rotation in said valve chamber, said rotary valve having a first end surface opposed to said partition;

a suction passage, formed in said rotary valve, for introducing the gas from said suction chamber to said first bore, said suction passage having an outlet opening at said first end surface and communicating with said first bore by way of said first port according to the rotation of the rotary valve when said first piston is in the suction stroke; and means for biasing said rotary valve towards said partition to urge said first end surface against said partition.

2. The compressor as set forth in claim 1, wherein said first end surface is flat.

3. The compressor as set forth in claim 1, further comprising:

a second piston;

a second cylinder bore in said housing for accommodating said second piston; and a second port in said partition, wherein said first port and said second port introduce gas to the first cylinder bore and the second cylinder bore, respectively, from said suction chamber via said suction passage.

4. The compressor as set forth in claim 3, wherein:

said first end surface has a groove for connecting one of said first and second ports with the other one of said ports when one of said first and second pistons is substantially at the end of the discharge stroke and the other one of said pistons is in the compression stroke;

said first end surface further comprises a first portion surrounded by said groove; and said partition comprises a second portion between said first port and said second port, said second portion facing said first portion.

5. The compressor as set forth in claim 4, wherein said groove includes a first groove, a second groove and a third groove, said first and second grooves respectively having inner ends and outer ends and extending in substantially radial directions with respect to a rotation center of said rotary valve, said third groove extending along a rotational direction of said rotary valve and connecting said inner end of said first groove to said inner end of said the second groove, and said first portion being surrounded by said first groove, said second groove and said third groove on three sides of said first portion.

6. The compressor as set forth in claim 1, wherein:

said rotary valve has a second end surface opposite to said first end surface;

said valve chamber has an inner end surface facing said second end surface; and said biasing means defines a space between said inner end surface and said second end surface and a pressure passage for introducing a first pressure to the space, wherein said introduced first pressure is higher than a second pressure in said suction chamber.

7. The compressor as set forth in claim 6, wherein said pressure passage extends along said rotary valve to allow the passage of the first pressure from said first port.

8. The compressor as set forth in claim 6, wherein said pressure passage is defined by said rotary valve by an inlet opening at said first end surface and an outlet connected with said space to allow the passage of the first pressure from said first port.

9. The compressor as set forth in claim 4, wherein:

said rotary valve has a second end surface opposite to said first end surface;

said valve chamber has an inner end surface facing said second end surface; and said biasing means defines a space between said inner end surface and said second end surface and a pressure passage formed in said rotary valve to connect said space with said groove and introduce a first pressure in said groove to said space, wherein the introduced first pressure is higher than a second pressure in said suction chamber.

10. The compressor as set forth in claim 1, wherein said housing further comprises a cylinder block, wherein said first bore is within said cylinder block, and a housing member attached to said cylinder block, said cylinder block and said housing member defining said discharge chamber and said valve chamber.

11. The compressor as set forth in claim 10, wherein said partition comprises a plate interposed between said cylinder block and said housing member, said plate having a discharge port for discharging the gas to said discharge chamber from said first bore.

12. The compressor as set forth in claim 10, wherein said partition comprises a plate interposed between said cylinder block and said housing member, said plate having a discharge valve for discharging the gas to said discharge chamber from said first bore.

13. The compressor as set forth in claim 10, wherein said cylinder block includes said partition.

14. A compressor comprising a housing, a drive plate mounted on a drive shaft in said housing, at least a first piston and a second piston, a first cylinder bore and a second cylinder bore within said housing, wherein said first and second pistons are coupled to said drive plate and respectively disposed in said first and second cylinder bores, a suction chamber and a discharge chamber within said housing, wherein, the rotation of said drive shaft is converted by said drive plate to a reciprocating movement of said pistons between a top dead center and a bottom dead center in the associated cylinder bores to compress gas, wherein the gas is supplied from said suction chamber to each cylinder bore during a suction stroke in which each piston is driven from the top dead center to the bottom dead center, and wherein the compressed gas is discharged from each cylinder bore to said discharge chamber during a compression and discharge stroke in which each of said pistons is driven from the bottom dead center to the top dead center, said compressor further comprising:

a valve chamber defined in said housing;

a partition for partitioning said valve chamber and said first and second cylinder bores, said partition having at least a first suction port and a second suction port in association with said first and second cylinder bores, respectively, each of said suction ports connecting said valve chamber with the associated cylinder bore;

a rotary valve supported on said drive shaft for integral rotation in said valve chamber, said rotary valve having a first flat end surface opposed to said partition;

a suction passage, defined by said rotary valve, for introducing the gas from said suction chamber to the cylinder bores, said suction passage having an outlet opening at said first end surface and communicating with one of said cylinder bores by way of the associated suction port according to the rotation of said rotary valve when the associated piston is in the suction stroke;

means for biasing said rotary valve towards said partition to urge said first end surface against said partition;

said first end surface having a groove for connecting said first and second suction ports when one of said pistons is substantially at the end of the discharge stroke and the other said pistons is in the compression stroke;

said first end surface having a first portion surrounded by said groove; and said partition having a second portion between said first suction port and said second suction port, said portion facing the first portion.

15. The compressor as set forth in claim 14, wherein said groove includes a first groove, a second groove and a third groove, said first and second grooves respectively having inner ends and outer ends and extending in substantially radial directions with respect to a rotation center of said rotary valve, said third groove extending along a rotational direction of said rotary valve and connecting said inner end of said first groove to said inner end of said second groove, and said first portion being surrounded by said first groove, said second groove and said third groove on three sides of said first portion.

16. The compressor as set forth in claim 15, wherein:

said rotary valve has a second end surface opposite to said first end surface;

said valve chamber has an inner end surface facing the second end surface; and said biasing means defines a space between the inner end surface and the second end surface and a pressure passage for introducing a first pressure to the space, wherein said introduced first pressure is higher than a second pressure in the suction chamber.

17. The compressor as set forth in claim 16, wherein said pressure passage extends along said rotary valve to allow the passage of the first pressure from at least one of said suction ports.

18. The compressor as set forth in claim 16, wherein said pressure passage is defined by said rotary valve by an inlet opening at said first portion of said first end surface and an outlet connected with said space to allow the passage of the first pressure from at least one of the suction ports.

19. The compressor as set forth in claim 16, wherein said pressure passage is defined by said rotary valve by an inlet connected with said groove and an outlet connected with said space to allow the passage of the first pressure from said groove.

20. The compressor as set forth in claim 14, wherein said housing further comprises a cylinder block, wherein said cylinder bores are within said cylinder block, and a housing member attached to the cylinder block to define said discharge chamber and said valve chamber.

21. The compressor as set forth in claim 20, wherein said partition includes a plate interposed between said cylinder block and said housing member, said plate having a discharge port for discharging the gas to said discharge chamber from each of said cylinder bores.

22. The compressor as set forth in claim 20, wherein said partition includes a plate interposed between said cylinder block and said housing member, said plate having a discharge valve for discharging the gas to said discharge chamber from each of said cylinder bores.

* * * * *

UNITED STATES PATENT AND TRADEMARK OFFICE

CERTIFICATE OF CORRECTION

PATENT NO. : 5,562,425
DATED : October 8, 1996
INVENTOR(S) : K. Kimura et al

It is certified that error appears in the above-indentified patent and that said Letters Patent is hereby corrected as shown below:

Column 2, line 55, "strike" should read --stroke--.

Column 6, line 58, before "flows" delete "will".

Column 7, line 67, $(Pe \cdot S_2)$ should read --$(Pe \cdot S_1)$--.

Column 8, line 20, after "formed" insert --in--;
line 50, after "24" delete "is," insert --communicates,--.

Column 13, line 56, after "other" insert --one of--.

Signed and Sealed this

Fifteenth Day of April, 1997

Bruce Lehman

*Attest:*

BRUCE LEHMAN

*Attesting Officer*

*Commissioner of Patents and Trademarks*